US007238936B2

(12) United States Patent
Okamura et al.

(10) Patent No.: US 7,238,936 B2
(45) Date of Patent: Jul. 3, 2007

(54) DETECTOR WITH INCREASED DYNAMIC RANGE

(75) Inventors: Mark M. Okamura, Austin, TX (US); Michael W. Senko, Sunnyvale, CA (US); Scott T. Quarmby, Round Rock, TX (US); Jae C. Schwartz, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 28 days.

(21) Appl. No.: 11/020,744

(22) Filed: Dec. 23, 2004

(65) Prior Publication Data

US 2006/0020400 A1 Jan. 26, 2006

Related U.S. Application Data

(60) Provisional application No. 60/585,016, filed on Jul. 2, 2004.

(51) Int. Cl.
*H01J 49/40* (2006.01)

(52) U.S. Cl. ..... 250/284; 250/288; 250/286

(58) Field of Classification Search ..... None
See application file for complete search history.

(56) References Cited

U.S. PATENT DOCUMENTS 3,510,647 A 5/1970 Wood
3,823,315 A 7/1974 Mosharrafa
3,920,986 A 11/1975 Fies, Jr.
3,946,229 A 3/1976 Moseman, Jr. et al.
4,851,673 A 7/1989 Izumi et al.
5,448,061 A 9/1995 Wells
5,926,124 A 7/1999 Shimomura
6,674,068 B1 * 1/2004 Kammei ..... 250/287
2002/0175292 A1 11/2002 Whitehouse

FOREIGN PATENT DOCUMENTS

EP 0774773 B1 9/2003
GB 1484742 A 9/1977
WO WO 02/097856 12/2002

OTHER PUBLICATIONS

Kristo, M. J. et al, "System for Simutaneous Count/Current Measurement with a Dual-Mode Photon/Particle Detector," Rev. Sci. Instrum., vol. 59 ( No. 3), p. 438, (1988).
Beavis, Ronald C., "Increasing the Dynamic Range of a Transient Recorder by Using Two Analog-to-Digital Converters," J. Am Soc Mass Spectrom, p. 107-113, (1996).

* cited by examiner

*Primary Examiner*—David A. Vanore
(74) *Attorney, Agent, or Firm*—Sharon Upham

(57) ABSTRACT

A detector assembly has a current measuring device with a saturation threshold level, and a gain variation means. A signal is generated in response to the particles detected, a first data point corresponding to a peak of interest is acquired from the signal. If the first data point is near, at or above the saturation threshold level of the current measuring device, the gain of the gain variation means is adjusted such that the peak of interest in the signal is reduced in intensity.

26 Claims, 4 Drawing Sheets

DETECTOR WITH INCREASED DYNAMIC RANGE

CROSS-REFERENCE TO RELATED APPLICATIONS

This application claims priority to U.S. Provisional Application Ser. No. 60/585,016, filed Jul. 2, 2004.

BACKGROUND

The invention relates to increasing the dynamic range of a detector. In particular, increasing the dynamic range of a detector used in a mass spectrometer system.

The linear dynamic range of mass spectrometers can often be limited by the ion detection system. Ion sources are now intense enough that the number of ions delivered to the detector is large enough to saturate the detection system. This issue, in some respects, is more critical in ion trap instruments, which attempt to regulate the exact number of ions contained in the trap using a prescan measurement technique. In this case, any saturation effect of the detector would result in substantial space charge effects in the desired mass spectrum. Consider for example, the analytical scan for which a prescan experiment is performed prior to the analytical scan in order to obtain a measurement of the flux of the ion beam. The measurement can then be used to determine the ion accumulation time used for the analytical scan. However, by using a fixed prescan ion accumulation time, there is a possibility that one or more of the peaks in the prescan will saturate the detector electronics if the ion current from the source is high. Under these conditions, the measured total ion current (TIC) will be less than the actual TIC. Use of this low TIC results in the calculation of an ion accumulation time for the subsequent analytical scan which is erroneously high, causing possible space charge to occur and therefore an overall reduction in performance in the mass spectrometer.

In the case of a typical quadrupole ion trap mass spectrometer, as the API source has become more efficient, the normal prescan ion accumulation time of 10 ms can cause the electrometer to be saturated by the current produced by the electron multiplier. The saturation is even more likely to occur during the prescan measurement primarily because of the higher scan rate (0.015 ms/amu which is 12 times the analytical scan rate) ejects ions faster, resulting in narrower, taller peaks.

Again, in the case of an ion trap mass spectrometer, the result is that the ion trap can be overfilled for the subsequent analytical scan, resulting in reduced performance.

For linear ion traps, the saturation problem is more severe for several reasons. First, a linear trap fundamentally can hold more ions (has a higher dynamic range) and therefore will deliver more ions to the detector. Second, the linear ion trap can be operated with two detectors, which then doubles the detected current. Third, the higher resolution of the current linear ion traps allows for even higher scan rates during the prescan (20-50 times the analytical scan rate) and higher scan rates produce higher detected currents (narrower but taller).

In some instances, the dynamic range limitation of the detection system can be caused by the saturation of the analog to digital conversion component (ADC). For example, a 16-bit analog to digital conversion (ADC) is limited to a maximum of 4.8 orders of magnitude (log $2^{16}$). This is because a 16-bit ADC has a range of possible digital output values from 0 to 65535 counts. When using such a component, one must typically adjust the gain of the detector, or that of the amplifier between the detector and the ADC input so that a single ion pulse amplitude produces a signal at the ADC input that corresponds to several digital counts. This is so that most of the single ion pulse amplitudes are large enough to register at least one bit on the digital counter. Otherwise, the single ions that produce output pulses with amplitudes that fall below that threshold will not be recorded, resulting in an error in the intensities measured. So in practice, a 16-bit ADC has less than 4.8 orders of magnitude of dynamic range. Typically, the effective dynamic range would be about 3.5 orders of magnitude.

When the ADC at the output of the ion detector has insufficient dynamic range, several methods can be used to improve it.

First, existing methods of increasing this range have included multi-anode electron multipliers. Here, different percentages of the ion signal are collected on different anodes, and one anode collects a larger percentage of the ion signal than the other. Multiple electrometers are used to measure these currents. The electrometer with the best measurement is then used. It can be difficult to keep the relative gain between these channels constant though, and the systems are more complex because they require two, or more, ADCs.

Second, non-linear amplifiers can be used. With these, the gain changes as a function of the input signal. For example, if the output of the amplifier is the input$^A$ where $0<A<1$, then the input signal range will be compressed into a narrower output signal range. This allows a wider input signal range to fit within the dynamic range of the ADC. However, resolution is reduced. This makes the quantization error worse across the entire input signal range compared to linear amplifiers where A=1. On the other hand, logarithmic amplifiers can be used where the output is B*log(input)+C where B and C are constants. With proper choice of B and C, the quantization error at low input signals is actually improved compared to linear amplifiers. However, the quantization error will be worse at high input signals compared to linear amplifiers. Unfortunately, logarithmic amplifiers often have low bandwidth, which adversely affects dynamic range. They also have poor temperature stability making them complicated and expensive to produce.

Third, ion detection systems have been used that switch the gain of the signal based on the input signal. For example, the gain of the analog amplifier can be adjusted. These systems typically have two or more gain stages that can be selected from. The problem is that the input signals can change rapidly and typically the switching circuit is not fast enough to keep up. In addition, such systems are typically expensive and complicated to produce.

There is a need to develop detection systems that are able to operate over a high dynamic range, able to detect particles over a wide range of intensities, from weak to strong intensities without suffering from saturation or an overly low detection threshold in the noise band. Furthermore, there is a need for a detection system that is capable of operating in real-time, enabling high speed detection to be facilitated whilst once again, operating under conditions such that saturation or low detection threshold levels are not an issue. Methods and apparatus' providing a simpler method of increasing the dynamic range while maintaining good resolution are required.

SUMMARY

In one aspect of the invention a method and apparatus are provided for use in ion trap instruments (for mass spectrometry, for example) which utilize a prescan for controlling space charge effects, determining the most intense peak of the prescan (or prior analytical scan, or combination of prior analytical scans) and then varying the gain variation means between the prescan (or prior analytical scan, or combination of prior analytical scans) and the analytical scan to counteract the effects of the variable ion population, so that the most intense peak (with respect to mass to charge ratio) does not saturate the detection circuitry during the analytical scan.

Essentially, the current invention controls the resultant maximum peak height of the analytical scan through control of the detection parameters.

According to one aspect of the invention, a method and apparatus is provided to prevent the saturation of a detector assembly, the detector assembly comprising a current measuring device that has a saturation threshold level, and a gain variation means. The method includes generating a signal in response to the particles detected, acquiring a first data point from the signal, determining if the first data point is near, at or above the saturation threshold level of the current measuring device, and for a first data point that is near, at or above the saturation threshold level of the current measuring device, adjusting the gain of the gain variation means such that the portion of the signal corresponding to the data point is reduced in intensity.

According to another aspect of the invention, a method and apparatus is provided to prevent the saturation of a detector assembly, the detector assembly comprising a converting means that has a saturation threshold level, and a gain variation means. The method includes the steps of generating an analog signal in response to the particles detected during a scan, acquiring a first data point from the scan; determining if the first data point is near, at or above the saturation threshold level of the converting means, and prior to acquiring a subsequent data point from the scan, for a first data point that is near, at or above the saturation threshold level of the converting means, adjusting the gain of the gain variation means such that the intensity of the subsequent data point is reduced in intensity.

Implementations of these inventions may include one or more of the following features. The reduction in intensity may be such that the most intense peak is below the saturation threshold level of the current measuring device or the converting means. The detector assembly may detect the number of ions ejected or extracted during data acquisition in mass spectrometry. Alternatively, the detector assembly may detect the number of photons ejected or extracted during data acquisition in mass spectroscopy. The photon detector can include a photomultiplier or a microchannel plate photo multiplier.

The analog signal can be generated from a prescan, prior analytical scan, or a combination of prior scans. The first data point can be achieved utilizing predetermined data. A subsequent data point can be generated from a subsequent analog signal, and the subsequent analog signal may be generated from an analytical scan.

The gain variation may be provided by amplification or by attenuation. The gain variation may provide at least two gain settings. The gain settings may be substantially discrete or vary substantially continuously from a first to at least a second gain setting. The gain variation may be provided by a VGA (variable gain amplifier). One of the gains settings may be substantially one, and another of the gain settings may be in the range of 2 to 4096, such as 64 or 128

The variable gain means may be adjusted in real-time during a scan such that the intensity of the signal does not saturate the detection circuitry. This aspect of the invention can be utilized during any type of scan, whether it be a prescan, prior analytical scan, or analytical scan. The gain can be adjusted between the prescan or prior analytical scan and the analysis scan. The variable gain means may be fast enough to change its gain between the two scans, for example, the gain may be varied from the first to the second setting in less than 100 milliseconds. The gain variation means include a current measuring device, a variable analog to digital (ADC) component, a pre-amplifier, an electron multiplying device, a particle-electron conversion element, or an electrometer.

The converting means may include an ion counting detector, a multiple ion counting detector, a Time to Digital Converter (TDC), an Analog to Digital Converter (ADC), a combination of a TDC and an ADC, a microchannel plate, a discrete dynode electron multiplier.

The steps may be performed in the order recited.

The first data point being a peak of interest in the signal. The peak of interest may be the most intense peak, or the peak of interest may correspond to a preselected species, or the peak of interest may be the most intense peak that corresponds to a preselected set of species, or the peak of interest may be the most intense peak that does not correspond to a preselected set of species. The signal may be an analog signal.

Unless otherwise defined, all technical and scientific terms used herein have the meaning commonly understood by one of ordinary skill in the art to which this invention belongs. In the case of conflict, the present specification, including definitions, will control. Unless otherwise noted, the terms, "include", "includes" and "including", and "comprise", "comprises" and "comprising" are used in an open-ended sense—that is, to indicate that the "included" or "comprised" subject matter is or can be a part or component of a larger aggregate or group, without excluding the presence of other parts or components of the aggregate or group. The details of one or more implementations of the invention are set forth in the accompanying drawings and the description below. These embodiments are described in sufficient detail to enable those skilled in the art to practice the invention. However it is to be understood that other embodiments may be utilized and that logical, mechanical and electrical changes may be made without departing from the spirit of the invention. Further features, aspects, and advantages of the invention will become apparent from the description, the drawings, and the claims.

BRIEF DESCRIPTION OF THE DRAWINGS

Like reference numbers and designations in the various drawings indicate like elements.

DETAILED DESCRIPTION

Numerous types of detector arrangements exist for the measurement of particles such as ions, electrons, photons and neutral particles. Although the invention will be described in terms of the detection of ions in mass spectrometry applications, it can be extended to apply to the detection of many other types of particles in many other applications. For example, the detection of photons for spectroscopy.

Figure 1:
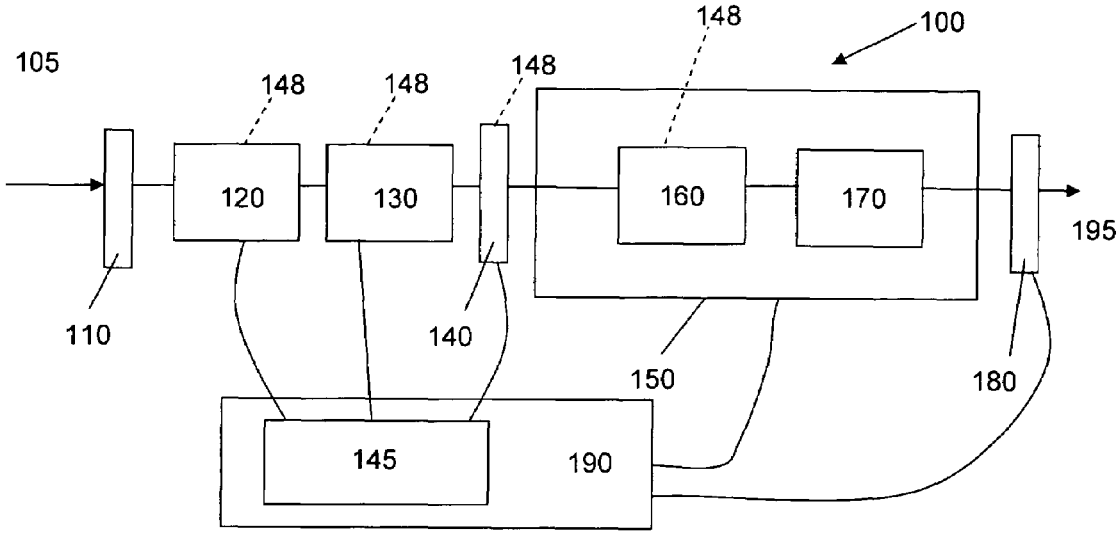
FIG. 1 is a schematic representation of a prior art mass spectrometer detection arrangement.

Referring now to the drawings, FIG. 1 is a schematic representation of one form of prior art mass spectrometer detector assembly 100.

The detector assembly 100 receives ions 105 which emanate from an ion source (not shown) as either a beam of ions (continuous or non-continuous) or in pulses. The ions 105 generated are either of or from a substance to be analyzed. The ions 105 may be directed by conventional ion optics and/or mass separation techniques 110 to the detection system.

Ion detection systems generally comprise an ion converting element 120 (for example a conversion dynode) followed by an electron multiplying element 130 (such as a continuous-dynode electron multiplier). In some implementations, the ions directly impinge the surface of the electron multiplying element 130, and consequently no ion-electron converting element 120 is required (such as in the case of a microchannel plate). A current measuring device 140, such as an anode combined with a pre-amplifier, is disposed to receive the particles produced by the electron multiplying element 130. An analog processing unit 145 is connected to the current measuring device 140 enabling the analog signal derived therefrom to be analysed if required. A converting means 150 is provided to respond to the current flow generated in the current measuring device 140 to ultimately produce an output signal 195. The converting means can consist of an amplifier 160 and an ADC (Analog-to-Digital Converter) 170, for example. The ADC 170 generates a series of digital signals representative of the amplified signal. When passed to a digital signal processor 180, a representation of the intensity of the original ion beam spectrum can be attained. Some or all of the components of system 100 can be coupled to a system control unit, such as an appropriately programmed digital computer 190, which receives and processes data from the various components and which can be configured to perform detection analysis on the data received.

Typically, in order to obtain more meaningful results from an ion trapping type of mass spectrometer, the issue of the space charge conditions in the analysis cell of the mass spectrometer is addressed, conventionally by using AGC (automatic gain control), a method by which the total charge in the analysis cell of the mass spectrometer is maintained at a constant level, generally an optimum level for all analytical scans.

Conventionally, the AGC method requires that prescan experiments or prior analytical scan experiments be performed so that a measurement of the current flux of ions can be ascertained and an adjustment of the ionisation parameters can be made to achieve the optimum level of charge in the analytical scan. Generally, these prescans or prior analytical experiments are carried out using the same detector settings as the actual analytical experiment, and the control of the ion population is provided through adjustment of the ion accumulation time.

Figure 2:
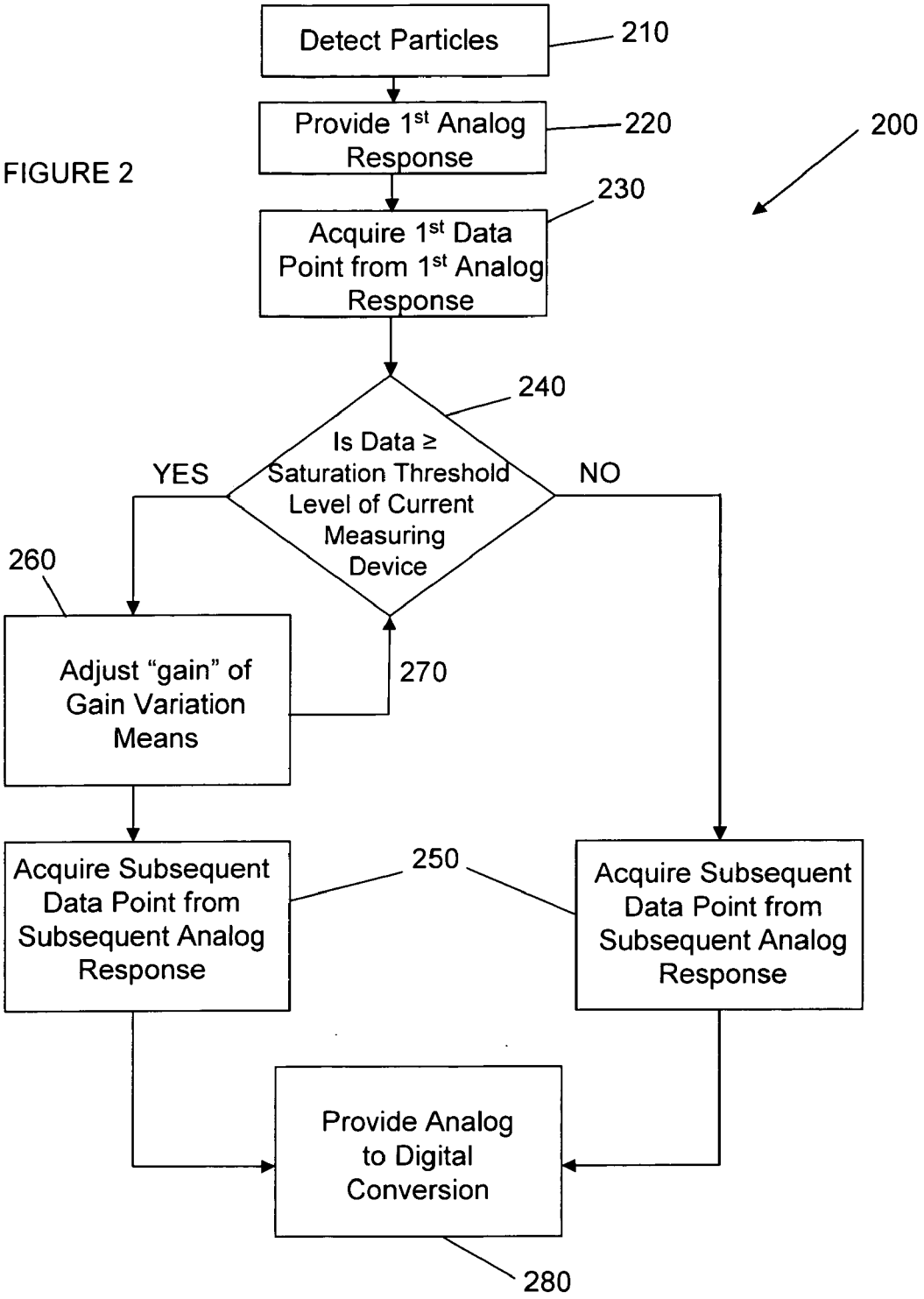
FIG. 2 is a flow chart of a detection process according to one aspect of the invention.

FIG. 2 is a flow chart of an alternative process performed by the detector assembly 100 in accordance with an aspect of the invention. In block 210, the detector (typically including a combination of the ion converting element 120 and the electron multiplying element 130) will detect all of the ions that have been generated during a first scan. Current measuring device 140 receives these ions and produces an output in the form of an analog waveform, block 220. From this, a first data point can be taken, as illustrated by block 230. The first data point is a peak of interest from the first scan. The peak of interest can be the most intense peak (the maximum peak height), or a peak that corresponds to a preselected species, or the most intense peak that corresponds to a preselected set of species, or most intense peak that does not correspond to a preselected set of species.

In decision block 240 the analog processing unit 145 determines whether the first data point is near, at, or above the saturation threshold level of the current measuring device 140. Near is defined as being close enough to the saturation threshold level that the next data point may be above the saturation threshold level. This possibility may be determined by knowing the maximum amount the signal can change between data points.

If the first data point is not near, at, or above the saturation threshold level of the current measuring device 140, the detector arrangement can be provided with ions during a subsequent scan, block 250. It is known that the data acquired from this subsequent scan will not saturate the current measuring device 140. The analog waveform is then converted to digital data in block 280, the digital data being indicative of the intensity of the ions 105 generated during the subsequent scan.

In the event that the data is near, at or above the saturation threshold level of the current measuring device 140, the number of electrons entering the current measuring device 140 is adjusted as illustrated in block 260, utilizing what we have labelled a gain variation means, the gain variation means typically provides at least two gain settings. The gain variation means is a means for reducing the gain or increasing the attenuation of the signal such that the signal intensity of the first data point (e.g., the most intense) acquired during the first scan is effectively reduced. In this embodiment, the gain variation means 148 acts on the entire signal received, and once it has either reduced, increased or left the gain/attenuation of the signal at its initial intensity level, substantially the entire signal proceeds to the converting means 150. Depending upon the apparatus configuration utilized, there may only be one level of attenuation attainable, so once step 260 has been carried out, the detector assembly and subsequently the current measuring device 140 is provided with ions during a subsequent scan, block 250.

In the event that more than one attenuation level is attainable, one may reiterate the process as illustrated by line 270 and once again check whether the newly attenuated data measurement point is near, at or above the current measuring device saturation threshold level (block 240), and determine whether further attenuation of the signal is required. If further attenuation is required, steps 260, 270 and 240 can be reiterated as necessitated. If no further attenuation is required, it will be known that the data acquired from the subsequent scan will not saturate the current measuring device 140, and the analog data can be converted to digital data as indicated in block 250, and data indicative of the intensity of the ions generated during the subsequent scan can be acquired.

In one aspect of this present invention, the first data point acquired is a measurement of the intensity of a data point taken during a first scan, the first scan being a prescan, prior analytical scan or analytical scan, or a predetermined value.

The subsequent data point acquired is a measurement of the intensity of a subsequent data point taken during a susbsequent scan, the subsequent scan typically being an analytical scan.

In yet a further aspect of this invention, the first data point and the subsequent data points are acquired during the same scan, that scan being a prescan, prior analytical scan or analytical scan. By utilizing first and subsequent data points within the same scan, real-time adjustment of the gain of the gain variation means can be achieved, thereby increasing the duty-cycle for this method.

The reduction of the gain of the gain variation means has to be performed in a quantitative manner so that the AGC algorithm is still effective and that relative quantitative information is maintained. Otherwise, AGC algorithms will not provide an accurate ion accumulation time for the subsequent analytical scan. For example, if a prescan is measured with a 4× reduced gain because of prior detector saturation, the measured ion current of this prescan must be mathematically increased 4× before calculating the number of ions to account for the reduced gain of the detector. For scan-to-scan type experiments, the initial current measuring device gain can be restored when the maximum peak height of the prescan or prior analytical scan drops down to a range that would not result in saturation of the current measuring device. For within-scan type experiments, the initial current measuring device gain can be restored when the first data point is indicative of a signal which is not near, at or above the saturation threshold level of the current measuring device.

Although it is possible to use either a prescan or prior analytical scan to determine the maximum peak height, using a prescan is more desirable. Prescans can utilize fast scanning, which results in a measurement very close in time to the analytical scan time, and therefore provides an accurate estimation of the maximum peak height that will be observed during subsequent scans. Because the prescan may be acquired under different conditions, such as fast scanning, one needs to adjust the peak heights observed when predicting what will happen in the analytical scan. For example, scanning 12× faster may produce peaks, which are 10× taller. The intensities from the prescan would be divided by 10 to predict the maximum peak height in the analytical scan. Also when the type of analytical scan is switching from one type to another, the previous scan is not appropriate to use for estimating the maximum peak heights. In this case, one can use prescans which are specific to each analytical scan type. Another case is when different ions are measured in the prescan and the analytical scan. This can be the case with MSn scans. One sometimes uses prescans which measure the precursor ion current rather than the product ion current as in the analytical scan. In this case, one cannot use the prescan to predict maximum peak heights in the analytical scan. One must use a prescan which measures the product ion current or rely upon the previous analytical scan.

The saturation threshold level can be acquired from an actual measurement taken, or based on the system architecture, past knowledge, look-up tables etc.

The number of electrons entering the current measuring device 140 can be adjusted in several ways, utilizing the gain variation means which typically has at least two gain settings. The gain variation means is not illustrated in the Figures as a discrete component since it may be found in existing elements of the detector arrangement. For example, the parameters of the current measuring device 140 itself or the elements disposed before or after the current measuring device 140 can be used to provide for the gain variation means.

In one aspect of the invention the gain variation means 148 is provided by the ion-electron conversion element 120 (and possibly the electron multiplying element 130) which can be adjusted to vary the number of electrons that are produced for each incoming ion. If an electron multiplier is employed, this can be achieved by adjusting the applied cathode voltage.

In another aspect of the invention, the gain variation means 148 can be provided by the current measuring device 140 which can include a variable gain/attenuation stage before the analog-to-digital conversion process.

In yet a further aspect of the invention, the gain variation means 148 can be provided by the amplifier 160.

In the case of a linear ion trap two or more detectors can be utilized, ensuring that all the ions ejected from the ion trap are detected, not just a portion of them. Typically two detectors are employed, the detectors being placed adjacent corresponding slots or apertures in the rods of the linear ion trap structure. The output of each respective detector generally leads to one common current measuring device 140, and the current from both detectors is summed since the essence of this invention depends upon the total number of ions being detected, and not on which slot or aperture these ions have emanated from. In order to ensure the current measuring device 140 is not saturated during the analytical scan, one of the two or more detectors is turned off during the prescan. Effectively, the gain variation means is provided by the detectors themselves. This reduces the number of electrons that are provided to the current measuring device. It reduces the number of ions detected by half (assuming two detectors are employed). During the acquisition of the subsequent data point during the subsequent scan, both detectors can be turned on, and the current detected from both summed to provide the total intensity of ions detected at the current measuring device. If a single detector is used during acquisition of the first data point, it is suggested that one alternates back and forth between the two available detectors, so that each is exposed to a similar number of ions and age at a similar rate. The lifetime of an electron multiplying device 130 is often determined by the number of electrons it outputs. To ensure that they age at approximately the same rate, both should output approximately the same average number of electrons.

The gain variation means can enable the number of electrons entering the current measuring device to be adjusted in either discrete steps or in a continuous fashion. For a continuous variation, the gain of the electrometer can be set to any arbitrary value after calibration to determine the gain as a function of applied voltage.

The gain variation means can also be achieved by utilizing several switchable input resistances in the conversion circuitry (current-to-voltage) of the current measuring device 140. The current measuring device could alternatively include a switchable voltage amplification stage in the amplifier 160 before the analog-to-digital conversion process.

There are two restrictions on what means can be used as the gain variation means. First, is that the means must change gain in a known, quantitative amount. Second, the means must change gain before the next measurement must be made. Otherwise, the duty cycle and subsequent efficiency of the system is reduced. For example, if there is 50 ms of time between the prescan and the analytical scan, then any means that can change gain within 50 ms can be used as the gain variation means. These means comprise the electron multiplying element 130, the current measuring device 140, and the amplifier 160.

As indicated earlier, although traditional 3D ion traps typically do not store sufficient ions to saturate the detector during the analytical scan, this is not the case for the linear ion trap, which is capable of storing and measuring much larger ion populations, especially when this larger capacity is used for a single m/z ion. In this case, the current measuring device gain during the analytical scan would be set based on a prescan or previous analytical scan. The previous analytical scan would be more useful because the difference in the measurement used for adjustment and the analytical scan would be minimized. The firmware and software would need to account for the varied input gain so that the signal level displayed to the user accurately reflects the number of detected ions.

Figure 3:
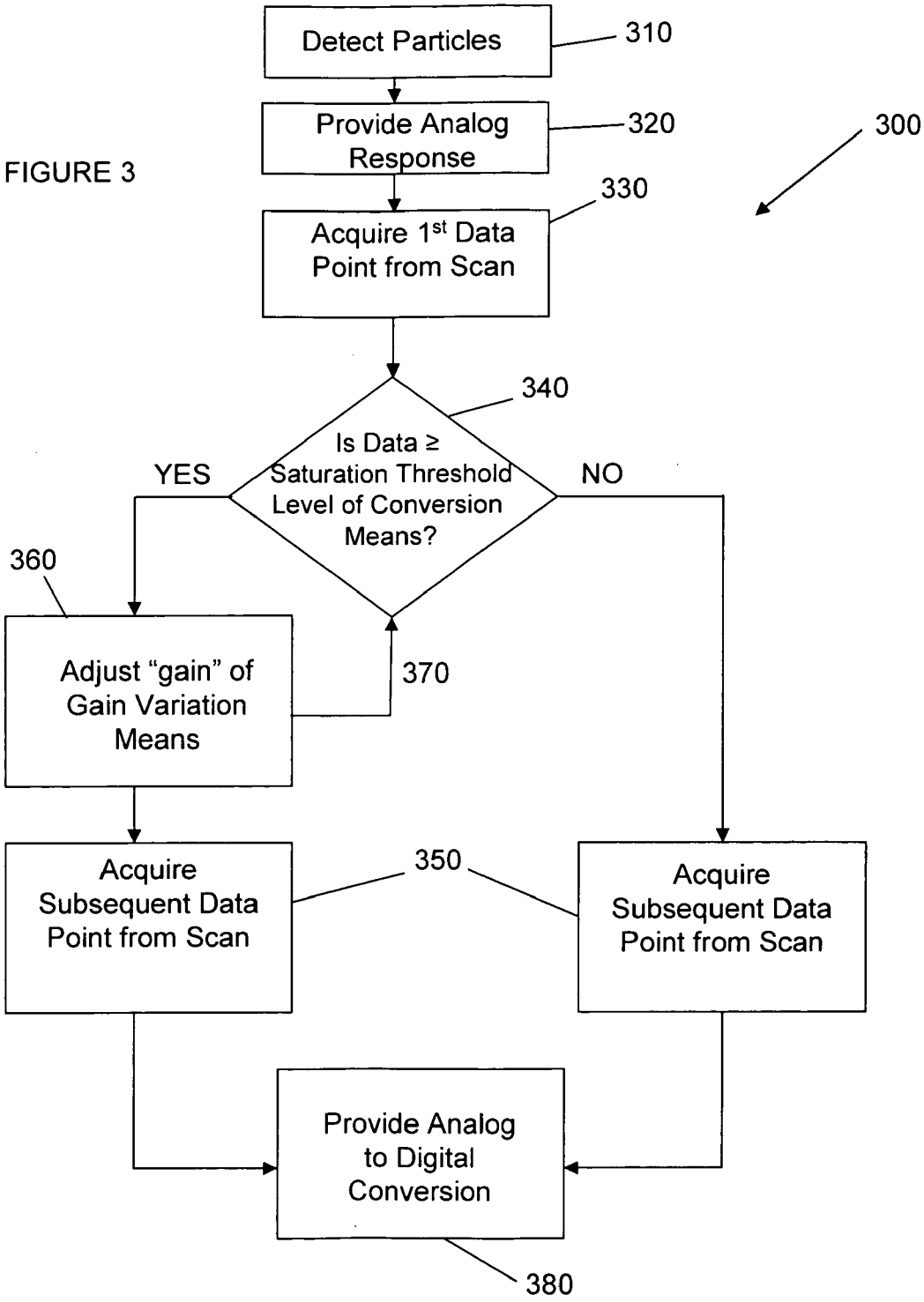
FIG. 3 is a flow chart of a detection process according to another aspect of the invention.

FIG. 3 is a flow chart of an alternative process performed by the detector assembly 100 in accordance to another aspect of the invention. In block 310, the detector (typically including a combination of the ion converting element 120 and the electron multiplying element 130) will detect one or more of the ions that have been generated during a scan. Current measuring device 140 receives these ions and produces an output in the form of an analog waveform, block 320. From this, a first data point can be taken, as illustrated by block 330. In decision block 340 the analog processing unit 145 determines whether the first data point is near, at or above the saturation threshold level of the conversion means 150, or any component thereof.

If the first data point is not near, at or above the saturation threshold level of the conversion means 150, the subsequent data point is taken from the same scan, block 350. It is known that the data acquired from this subsequent point should not saturate the conversion means 150 or any component thereof.

In the event that the first data point is near, at or above the saturation threshold level of the conversion means 150, the number of electrons entering the conversion means 150 is adjusted as illustrated in block 360, utilizing what we have labelled a gain variation means, the gain variation means providing at least two gain settings. The gain variation means is a means for reducing the gain or increasing the attenuation of the signal such that the signal intensity of the subsequent data point acquired during the scan is effectively reduced. Depending upon the apparatus configuration utilized, there may only be one level of attenuation attainable, so once step 360 has been carried out, the detector assembly and subsequently the current measuring device 140 is provided with ions during a subsequent scan, block 350.

In the event that more than one attenuation level is attainable, one may reiterate the process as illustrated by line 370 and once again check whether the newly attenuated data point is near, at or above the current measuring device saturation threshold level (block 340), and determine whether further attenuation of the signal is required. If further attenuation is required, steps 360, 370 and 340 can be reiterated as necessitated. If no further attenuation is required, it will be known that the subsequent data acquired from the scan should not saturate the conversion means 150, and the analog data can be converted to digital data as indicated in block 230, and data indicative of the intensity of the ions generated during the subsequent data point of the scan can be acquired.

Figure 4A:
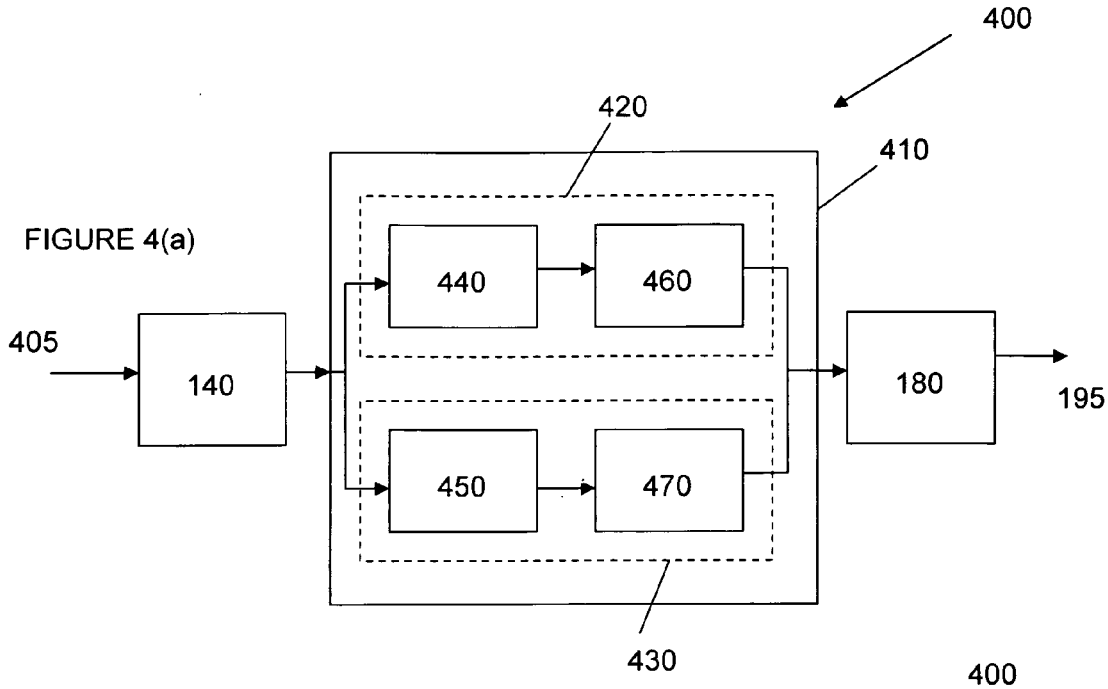
FIG. 4(*a*) to (*c*) are schematic representations according to aspects of the present invention.
Figure 4B:
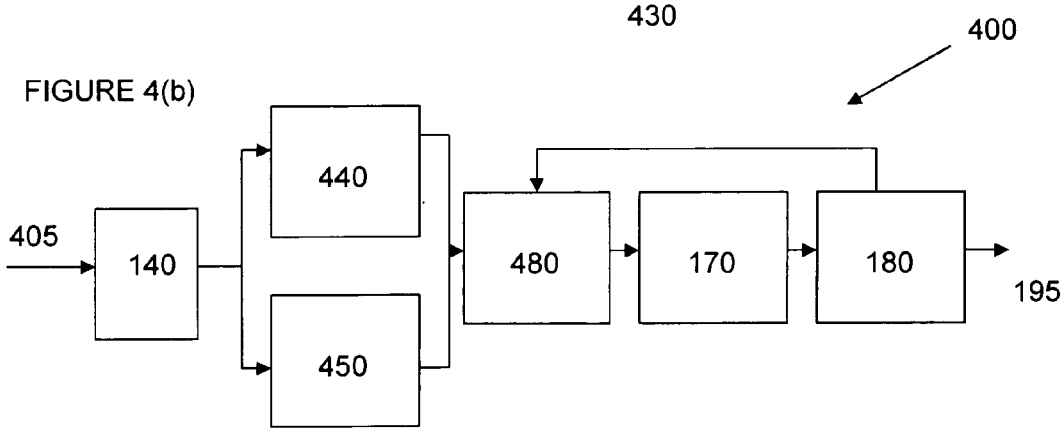
Figure 4C:
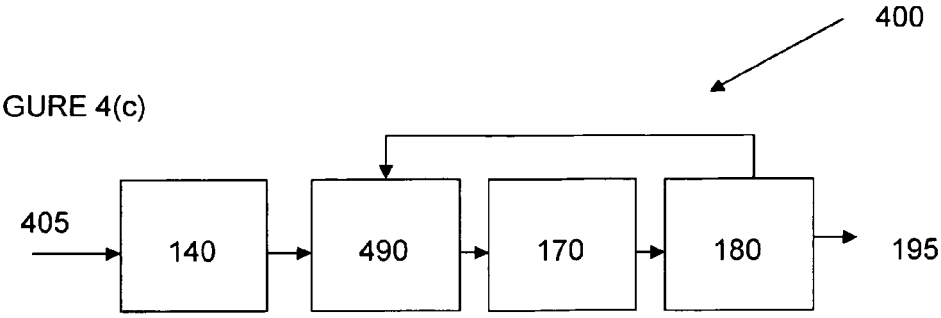

One form of detector system 400 for use in a mass spectrometer in accordance with this aspect of the present invention is shown in schematic form in FIG. 4. In this arrangement, gain of the amplifier 160 is varied, and the voltage measured by the analog-to-digital converter 170 is kept substantially constant. Effectively, the gain variation means is the amplifier 160 itself. This arrangement can be utilized between scans (for example, as described above), between the first scan which can be any one of a prescan, prior analytical scan, or multiple scans, and a second scan, typically an analytical scan. However, the arrangement described can more usefully be employed real-time within one particular scan.

In operation, the input signal 405 enters the current measuring device 140 before passing onto a converting means 410. The output signal from the converting means 410 is fed into a digital signal processor 180 which provides a representation of the intensity of the original ion beam spectrum.

As illustrated in FIG. 4(*a*), to facilitate this, two discrete converting means 420 and 430 are employed. Each converting means 420, 430 comprising an amplifier 440 and 450 respectively, wherein the first and second amplifiers 440 and 450 provide different amplifications relative to one another. In the configuration illustrated, each amplifier 440 and 450 is coupled to its corresponding ADC, 460 and 470 respectively.

The Digital Signal Processor (DSP) 180 scales the ADC output (from either 460 or 470) by the inverse of the gain of the amplifier stage (440 or 450) that was used to acquire the measurement point.

For example, during the acquisition of a first measurement point during a prescan or a prior analytical scan, the input signal 405 for a single point of the spectrum is split once it has been pre-amplified (140) and routed via amplifier stages 440 and 450. The current measuring device 140 can have a lower gain than is used in the prior art to prevent it from saturating with large input signals. For example, current measuring device 140 might have a gain (1/64)× what would be used in the prior art. This signal is passed to amplifier stage 440 which provides an amplification of 1×. This signal is then received by ADC 460. The overall gain of this channel is reduced from the prior art allowing larger input signals to be measured without saturation. In addition, the signal from the current measuring device 140 is passed to amplifier stage 450 which provides an amplification of 64×. This signal is then received by ADC 470. Effectively, the input signal has been amplified by the same amount as in the prior art. This allows small input signals to be measured as well as larger signals. Outputs from both ADCs 460 and 470 are received by the DSP 180. The outputs from both ADCs 460 and 470 may be received substantially simultaneously by the DSP 180.

DSP 180 is configured such that the signals derived from ADCs 460 and 470 are scaled appropriately to accurately represent the original signal that entered the ADC arrangement 410. For example, the signal that was acquired from the ADC 460, which was routed via the amplifier stage 440, is taken as is, amplified by 1× in the DSP 180. The signal that was acquired from the ADC 470, which was routed via the amplifier stage 450, is multiplied by (1/64)× in the DSP 180. Measurements of the peak of interest are used to indicate which of the amplifiers 440 or 450 is required for the analytical scan.

If both results are substantially the same, then ADC 470 is not being saturated by the signal, and the output emanating from the amplifier 450 can be utilized for acquisition of the analytical scan results. The output emanating from the amplifier 440 can be utilized, but the results attained may not be as accurate, particularly since the signal has not been amplified as much as the signal from the amplifier 450.

If the result emanating from the ADC 460 is greater than that attained from the ADC 470, this, in fact, is an indication that the ADC 470 is saturated by the signal, and that the output emanating from the amplifier 440 can be utilized for the acquisition of the analytical scan results.

Such a multi-gain amplifier configuration enables the gain to be adjusted between every measurement point acquired, ensuring that the issue of saturation of the detector is accommodated, and addressing the varying ion population issues.

In another aspect of the invention, rather than utilizing the signals emanating from ADCs 460 and 470 to determine the variation (typically in terms of amplification or attenuation) required for the analytical scan or the subsequent data point in the same scan, one can just choose between the output of 460 and 470. When 470 is near, at or above saturation, 460 would be chosen. If neither signal is near, at or above saturation, 470 could be chosen since it is likely to have less noise. Alternatively, 460 and 470 could be combined for example by averaging the values. If both signals are near, at or above saturation, 460 would be used since it will be less saturated than 470. In essence, this particular configuration picks the best signal of those available. No subsequent or second data point is measured to replace this one. Since the signals are both available, the choice of which to use can be done in real-time (before the next point is acquired) or after all of the data points have been acquired.

An alternative configuration which accomplishes an equivalent result as that illustrated in FIG. 4(*a*) is illustrated in FIG. 4(*b*). Here, an analog switch 480 is used to select between the outputs of two different gain amplifiers 440 and 450.

In this arrangement, for example, during the acquisition of a first measurement point during the prescan or prior analytical scan, the input signal 405 for a single point of the spectrum, is routed via the amplifier stage 440 and the amplifier stage 450. Once again, the amplifier stage 440 provides an amplification of 1×, and the amplification stage 450 provides an amplification of 64×. For the acquisition of the first measurement point during the analytical scan, typically the analog switch 480 is switched such that the signal emanating from the amplifier stage 450 is routed to the ADC 170 and eventually to the DSP 180. If the measurement of the peak of interest of the first measurement point of the analytical scan is below the saturation of the ADC 170, the DSP 180 allows the analog switch to remain in its current position, and during the acquisition of the subsequent measurement point of the analytical scan the signal emanating from the amplifier stage 450 is sent to the ADC 170.

In the event that the measurement of the peak of interest (e.g., the most intense peak) of the first measurement point of the prescan or the prior analytical scan is near, at or above the saturation of the ADC 170, the DSP 180 resets the analog switch 480 such that during the acquisition of the subsequent measurement point during the analytical scan the signal emanating from the amplifier stage 440 is sent to the ADC 170.

Yet another configuration is illustrated in FIG. 4(*c*) in which a variable gain amplifier (VGA) 490 is substituted in place of the amplifier stages 440 and 450, and the analog switch 480. The VGA 490 is typically an integrated chip such as the Analog Devices AD 8332 chip, which has an input that linearly varies the gain of the amplifier. The gain in such a chip can typically be adjusted in less than 500 ns. This means that it is feasible to alter the gain for every point acquired by the ADC and still achieve acquisition rates of 1 MHz (500 ns for gain change and 500 ns for ADC measurement). The gain error is typically in the region of +/−0.2 dB which means that the linearity will be within +/−2.3%.

Characterization of the gain linearity of the VGA would allow improved linearity by use of a correction table.

In this arrangement, for example, during acquisition of data indicative of the peak of interest (e.g., the most intense peak) in a prescan or prior analytical scan, the input signal 405 for a single point on the spectrum, is routed via the VGA 490 which is set to provide an amplification of 1×. This signal is then received by the ADC and the output eventually arrives at the input of the DSP 180. If the measurement of the peak of interest (e.g., the most intense peak) of prescan or the prior analytical scan is below the saturation of the ADC 170, the DSP 180 allows the VGA 490 to remain set at its current position when the analytical scan is carried out.

If the measurement of the peak of interest (e.g., the most intense peak) of the first measurement point of the analytical scan is near, at or above the saturation of the ADC 170, the DSP 180 adjusts the VGA 490, scaling the ADC output by the adjusted gain of the VGA 490 so that saturation of the ADC is avoided. Essentially the gain is varied in real-time during a scan. As a m/z peak starts, the VGA can drop the gain and then raise it again as the peak goes by.

Adjustment of the gain in real-time during a scan is practical if the gain can be changed sufficiently fast compared to the rate of change of the input signal. For the purposes of this patent, sufficient is defined as not changing so fast that the signal can go from unsaturated to saturated during the acquisition of a single data point. Alternatively, multiple previous data points could be used to calculate likely values for the next input signal.

When slower acquisition rates are needed, the gain does not need to be changed as quickly. For example, if acquisition rates of only 10 kHz are required then 50 μs to change the gain is sufficient. This is compared to acquisition rates of 1 MHz which require the gain to be changed within 500 ns. Slower rates allow more means to be used as the gain variation means. In addition to the amplifier stages 440 and 450, the current measuring device 140 could be used as the gain variation means. It has a higher gain which means it will respond slower to gain changes than the lower gain amplifier stages 440 and 450. If the gain of the electron multiplying element 130 could be varied quickly enough compared to the acquisition rate, it could also be used as the gain variation means.

Although the above configurations have been explained in terms of data indicative of the peak of interest of the prescan or the prior analytical scan, similar configurations could be utilized to determine the appropriate gain setting when acquiring data points for a prescan itself (or a prior analytical scan). In other words, saturation in a prescan could be avoided by adjusting the gain of the gain variation means based on information from the previous analytical scan.

In yet a further aspect of the invention, once a first data point has been taken, the decision block determines whether the first data point is near, at or above the saturation threshold level of the electron multiplier 130, or any component thereof.

The methods of the invention can be implemented in digital electronic circuitry, or in computer hardware, firmware, software, or in combinations of them. The methods of the invention can be implemented as a computer program product, i.e., a computer program tangibly embodied in an information carrier, e.g., in a machine-readable storage device or in a propagated signal, for execution by, or to control the operation of, data processing apparatus, e.g., a programmable processor, a computer, or multiple computers. A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a communication network.

Method steps of the invention can be performed by one or more programmable processors executing a computer program to perform functions of the invention by operating on input data and generating output. Method steps can also be performed by, and apparatus of the invention can be implemented as, special purpose logic circuitry, e.g., an FPGA (field programmable gate array) or an ASIC (application-specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. The essential elements of a computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in special purpose logic circuitry.

To provide for interaction with a user, the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

The various features explained on the basis of the various exemplary embodiments can be combined to form further embodiments of the invention.

Unless otherwise defined, all technical and scientific terms used herein have the meaning commonly understood by one of ordinary skill in the art to which this invention belongs. The disclosed materials, methods, and examples are illustrative only and not intended to be limiting. Skilled artisans will appreciate that methods and materials similar or equivalent to those described herein can be used to practice the invention.

What is claimed is:

1. A method for preventing particle saturation of a detector assembly, the detector assembly comprising a gain variation means and a device having a saturation threshold level, the device having an output and comprising at least one of an electron multiplying element, a current measuring device or a converting means, and the method comprising:

(a) generating a signal from the output in response to particles detected during a scan;

(b) acquiring a first data point from the generated signal;

(c) determining if the first data point is near, at or above the saturation threshold level; and (d) if the first data point that is near, at or above the saturation threshold level, adjusting the gain of the gain variation means such that-prior to acquiring a subsequent data point from the output for the same scan, the subsequent data point is reduced in intensity.

2. A method according to claim 1, wherein the scan is a prescan or analytical scan.

3. A method according to claim 1, wherein acquiring the first data point from the scan is achieved by utilizing predetermined data.

4. A method according to claim 1, wherein the gain variation means provides variation by amplification.

5. A method according to claim 1, wherein the gain variation means provides variation by attenuation.

6. A method according to claim 1, wherein the gain variation means provides at least two gain settings.

7. A method according to claim 6, wherein the at least two gain setting are substantially discrete.

8. A method according to claim 6, wherein the at least two gain settings vary substantially continuously from a first to at least a second gain setting.

9. A method according to claim 6, wherein the gain can be varied from the first to the second gain setting in less than 100 microseconds.

10. A method according to claim 1, wherein the gain settings are varied in real-time.

11. A method according to claim 1, wherein the steps (a) through (d) are performed in the order recited.

12. A method according to claim 1, wherein the first data point is a peak of interest in the signal.

13. A method according to claim 12, wherein the peak of interest is the most intense peak.

14. A method according to claim 12, wherein the peak of interest corresponds to a preselected species.

15. A method of preventing particle saturation of a detector assembly, the detector assembly comprising a gain variation means and a device having a saturation threshold level, the device comprising at least one of a electron multiplying element, a current measuring device or a converting means, the method comprising:

(a) generating an analog signal in response to particles detected during a scan;

(b) acquiring a first data point;

(c) determining if the first data point is near, at or above the saturation threshold level; and (d) for a first data point that is near, at or above the saturation threshold level, selecting one of at least two gain settings of the gain variation means such that the peak of interest in the analog signal is reduced in intensity, the outputs from the two gain settings being available for selection substantially simultaneously.

16. A method according to claim 15, wherein the intensity is reduced such that it is below the saturation threshold level.

17. A method according to claim 15, wherein the analog signal generated is from a combination of prescans.

18. A method according to claim 15, further comprising (e) generating a subsequent data point from a subsequent analog signal from an analytical scan.

19. A method according to claim 15, wherein the gain variation means provides variation by amplification.

20. A method according to claim 15, wherein the gain variation means provides variation by attenuation.

21. A method according to claim 15, wherein the gain variation is adjusted in real-time.

22. A method according to claim 15, wherein the steps (a) through (d) are performed in the order recited.

23. A detector arrangement comprising:

a detector assembly that provides an analog signal from a scan;

a converting means for converting the analog signal to an digital signal, the converting means having a saturation threshold level, and a gain variation means;

electronic gain means coupled prior to the detector and providing at least two substantially distinct gain value settings, the outputs from the two gain value settings available for selection substantially simultaneously; and a control unit for determining if the intensity of a data point from the analog signal is near, at or above the saturation threshold level of the converting means, and prior to taking a second data point from the analog signal during the same scan, controlling the converting means such that the first data point is reduced in intensity.

24. A computer program product tangibly embodied in a computer readable medium, comprising instructions to control a detector assembly to:

(a) generate a signal in response to particles detected during a scan;

(b) acquire a first data point from the scan via a device having a saturation threshold level;

(c) determine if the first data point is near, at or above the saturation threshold level; and (d) prior to acquiring a subsequent data point from the same scan, for a data point that is near, at or above the saturation threshold level, adjust the gain of the gain variation means such that the subsequent data point acquired from the device having an intensity threshold is reduced in intensity and does not saturate the device having a saturation threshold level.

25. A computer program product tangibly embodied in a computer readable medium, comprising instructions to control a detector assembly to:

(a) generate an analog signal in response to particles detected;

(b) acquire a first data point, the first data point being a peak of interest in the analog signal;

(c) determine if the first data point is near, at or above the saturation threshold level; and (d) for a first data point that is near, at or above the saturation threshold level, select one of at least two gain settings of the gain variation means, such that the peak of interest in the analog signal is reduced in intensity, the outputs from the at least two gain settings being available for selection substantially simultaneously.

26. A method according to claim 1, wherein the device having a saturation threshold level an electron multiplying element, a current measuring device or a converting means.

* * * * *